US011131119B2

(12) United States Patent
Hwang

(10) Patent No.: US 11,131,119 B2
(45) Date of Patent: Sep. 28, 2021

(54) LOCKER DIAL LOCK

(71) Applicant: Sang Sik Hwang, Goyang-si (KR)

(72) Inventor: Sang Sik Hwang, Goyang-si (KR)

( * ) Notice: Subject to any disclaimer, the term of this patent is extended or adjusted under 35 U.S.C. 154(b) by 97 days.

(21) Appl. No.: 16/620,435

(22) PCT Filed: May 30, 2018

(86) PCT No.: PCT/KR2018/006131
§ 371 (c)(1),
(2) Date: Dec. 6, 2019

(87) PCT Pub. No.: WO2018/230865
PCT Pub. Date: Dec. 20, 2018

(65) Prior Publication Data

US 2020/0131802 A1 Apr. 30, 2020

(30) Foreign Application Priority Data

Jun. 15, 2017 (KR) ..... 10-2017-0075631

(51) Int. Cl.
*E05B 37/02* (2006.01)
*E05B 65/02* (2006.01)
(Continued)

(52) U.S. Cl.
CPC ..... *E05B 37/02* (2013.01); *E05B 37/0031* (2013.01); *E05B 37/0041* (2013.01);
(Continued)

(58) Field of Classification Search
CPC ..... E05B 37/0031; E05B 37/0041; E05B 37/0048; E05B 37/0058; E05B 37/02; E05B 37/163; E05B 65/02; E05B 65/025
See application file for complete search history.

(56) References Cited

U.S. PATENT DOCUMENTS 4,885,923 A * 12/1989 Nakai ..... E05B 37/0031 70/284
5,345,798 A * 9/1994 Nakai ..... E05B 37/02 70/284
(Continued)

FOREIGN PATENT DOCUMENTS

JP 2009-167695 A 7/2009
KR 20-0349788 Y1 5/2004
(Continued)

*Primary Examiner* — Christopher J Boswell
(74) *Attorney, Agent, or Firm* — Maschoff Brennan

(57) ABSTRACT

The present invention relates to a locker dial lock, and more specifically has been made to enhance convenience of use by rotating a knob for operating a locking lever of a dial lock to a reset position not to a locking or opening position, and then identifying or resetting a combination of dials so as to simply change and reset the combination. The configuration of the present invention is a dial lock 1 configured such that a main body 3 including a key cylinder bundle 10 and a dial bundle 20 is installed at a front surface of a door of a locker, and when a plurality of dials 24 exposed to the outside of a cover 2 at a front surface of the main body 3 are rotated to match a set combination, the key cylinder bundle 1 is released and a door is opened by rotating a locking lever 4 at a back surface of the door along with a knob 11, and when the combination is forgotten, the knob 11 is rotated using a master key to press an operating rod 21 of the dial bundle 20, thereby allowing detection holes 23 provided on one side of connecting rod bodies 22 respectively fitted into and coupled to the plurality of dials 24 to be exposed, and the detection pins 55 of a detection means 30 that are provided on one side of the connecting rod bodies 22 are inserted into the detection holes 23 to determine a combination of the dials 24, wherein the detection means 30 includes: a manipulation member 40 having a push protrusion 41 at an upper portion thereof, including a return spring 42 at a lower portion thereof, and provided with a plurality of manipulation
(Continued)

uneven portions 43 on one side thereof, wherein the push protrusion 41 is pressed by a pressing cam part 13 further included in the key cylinder bundle 10, thus allowing the manipulation member 40 to be slidably moved upward or downward; and a detection member 50 positioned on one side of the manipulation member 40 and rotatably assembled to the main body 3 about a hinge pin 51, provided with detection uneven portions 53 on one side thereof to correspond to the plurality of manipulation uneven portions 43 about the hinge pin 51, and including the detection pins 55 provided on another side thereof and inserted into the detection holes 23 of the connecting rod bodies 22, wherein, when the combination is forgotten, the knob 11 is rotated to a setting position using a master key to allow the key cylinder bundle 10 to press the operating rod 21 of the dial bundle 20, thereby exposing the detection holes 23 provided in one side of the connecting rod bodies 22 respectively fitted into and coupled to the plurality of dials 24, and while the pressing cam part 13 of the key cylinder bundle 10 presses the push protrusion 41 of the manipulation member 40 to enable the manipulation member 40 to be moved downward, convex portions of the manipulation uneven portions 43 engaged with and coupled to the detection uneven portions 53 move while pushing convex portions of the detection uneven portions 53, thus enabling the detection means 30 to be rotated about the hinge pin 51 and the detection pins 55 to be inserted into the detection holes 23 of the connecting rod bodies 22, thereby detecting the combination of the dials 24.

5 Claims, 12 Drawing Sheets

(51) Int. Cl.
*E05B 37/00* (2006.01)
*E05B 37/16* (2006.01)

(52) U.S. Cl.
CPC ..... *E05B 37/0058* (2013.01); *E05B 65/025* (2013.01); *E05B 37/163* (2013.01)

(56) References Cited

U.S. PATENT DOCUMENTS

| | | | | |
|---|---|---|---|---|
| 6,508,089 | B1 * | 1/2003 | Tsai | E05B 37/02 70/213 |
| 6,598,434 | B2 * | 7/2003 | Yang | E05B 37/02 70/213 |
| 7,444,844 | B1 * | 11/2008 | Lee | E05B 37/02 70/21 |
| 10,513,871 | B2 * | 12/2019 | Wang | E05B 37/02 |
| 2004/0011098 | A1 * | 1/2004 | Yang | E05B 37/0031 70/284 |
| 2011/0041574 | A1 * | 2/2011 | Yang | E05B 37/02 70/315 |
| 2021/0071442 | A1 * | 3/2021 | Li | E05B 37/02 |

FOREIGN PATENT DOCUMENTS

| | | | |
|---|---|---|---|
| KR | 20-2009-0010702 | U | 10/2009 |
| KR | 10-2010-0090363 | A | 8/2010 |
| KR | 10-1145145 | B1 | 5/2012 |
| KR | 10-2012-0078088 | A | 7/2012 |
| KR | 10-1509537 | B1 | 4/2015 |

* cited by examiner

LOCKER DIAL LOCK

TECHNICAL FIELD

The present invention relates to a locker dial lock, and more particularly has been made to enhance convenience of use by rotating a knob for operating a locking lever of a dial lock to a reset position not to a locking or opening position, and then identifying or resetting a combination of dials to thereby conveniently change and reset the combination.

BACKGROUND ART

Generally, many lockers are installed in schools, libraries, or public areas shared by many people, i.e., public baths, department stores, train stations, and large discount stores, thus promoting user convenience.

Such lockers include a locking device using a key so as to lock or open a locker using a private key and a cylinder-type lock, and several dials used to set a combination, in which the several dials are rotated to match the set combination to thereby open or close a locker door.

In addition, in a conventional dial locker having the above-described configuration, when initially setting a combination, first, a locking lever of a door is opened using a private key or a key, a combination is set using several dials in a state in which the door is open, the door is closed and the locking lever is rotated back to the original position to allow the door to be in a locked state, and then the several dials are randomly rotated to maintain the locked state, by which a personal combination is set and recognized to open or close the door of the locker.

However, when using a dial lock having the above-described structure, cases frequently occur in which a locker cannot be opened because a user forgets a combination, or a previous user closes a door after finishing using a locker so that a next user cannot reset the combination, and thus reuse of the locker is impossible. In this case, there have been inconveniences such as use of the locker after a person in charge opens a door by operating the dial lock using a master key, and then initializes the combination.

To address these conventional problems, Korean Registered Utility Model Gazette No. 20-0349788 discloses a locker knob with a cylinder lock attached thereto, but in this case, when a combination of a dial lock is forgotten, the whole combination of the dial lock needs to be determined using a method of inserting detection pins into respective dial number detection holes and rotating connecting rod bodies along with dials in a state in which the tip of each pin is in contact with an outer surface of each connecting rod body to determine numbers consistent with inner grooves of the connecting rod bodies, and thus not only does it take a lot of time to determine the combination of the dial lock, but there are also very cumbersome and inconvenient problems in dial number detection using the detection pins, such as a process of continuously rotating dials until the detection pin is caught in the detection hole of the connecting rod body after being inserted into each dial number detection hole once is repeatedly performed.

Accordingly, the present applicant has addressed the above-described problem through Korean Registered Patent Publication No. 10-1509537, but when a combination of a dial lock is forgotten, the combination has to be initialized in a state in which a door of a locker is open, and thus there is a problem that a user has a burden to open the inside of the locker.

In addition, as the user directly presses an operation pin protruding from the lower portion of a main body, there are problems such as loss caused by the operation pin being easily broken or damaged so that the entire dial lock must be replaced, and inability to use a locker during the replacement period.

DISCLOSURE

Technical Problem

Therefore, the present invention has been made in view of the above problems, and it is one object of the present invention to enable a combination of dials to be identified or reset only by a manipulation of rotating a key bundle to a reset position through a master key in a state in which a door of a locker is closed.

It is another object of the present invention to rapidly and conveniently recognize a combination of dials by rotating a key bundle to a reset position such that dial connecting rod bodies are pressed to expose detection holes, and inserting each detection pin into the detection hole by rotating the connecting rod body along with the corresponding dial.

It is yet another object of the present invention to provide a structure in which detection pins, which are inserted into dial detection holes by operation according to the rotation of a key bundle, are embedded inside a dial lock, to facilitate manufacture and installation by simplifying configurations, and to prevent malfunction, thereby improving product satisfaction.

Technical Solution

In accordance with one aspect of the present invention, provided is a dial lock 1 configured such that a main body 3 including a key cylinder bundle 10 and a dial bundle 20 is installed at a front surface of a door of a locker, and when a plurality of dials 24 exposed to the outside of a cover 2 at a front surface of the main body 3 are rotated to match a set combination, the key cylinder bundle 10 is released and a door is opened by rotating a locking lever 4 at a back surface of the door along with a knob 11, and when the combination is forgotten, the knob 11 is rotated using a master key to press an operating rod 21 of the dial bundle 20, thereby allowing detection holes 23 provided on one side of connecting rod bodies 22 respectively fitted into and coupled to the plurality of dials 24 to be exposed, and the detection pins 55 of a detection means 30 that are provided on one side of the connecting rod bodies 22 are inserted into the detection holes 23 to determine a combination of the dials 24, wherein the detection means 30 includes: a manipulation member 40 having a push protrusion 41 at an upper portion thereof, including a return spring 42 at a lower portion thereof, and provided with a plurality of manipulation uneven portions 43 on one side thereof, wherein the push protrusion 41 is pressed by a pressing cam part 13 further included in the key cylinder bundle 10 such that the manipulation member 40 is slidably moved upward or downward; and a detection member 50 positioned on one side of the manipulation member 40 and rotatably assembled to the main body 3 about a hinge pin 51, provided with detection uneven portions 53 on one side thereof to correspond to the plurality of manipulation uneven portions 43 about the hinge pin 51, and including the detection pins 55 provided on another side thereof and inserted into the detection holes 23 of the connecting rod bodies 22, wherein, when the combination is forgotten, the knob 11 is rotated to a setting position using a master key to allow the key cylinder bundle 10 to press the operating rod 21 of the dial bundle 20, thereby exposing the detection holes 23 provided in one side of the connecting rod bodies 22 respectively fitted into and coupled to the plurality of dials 24, and while the pressing cam part 13 of the key cylinder bundle 10 presses the push protrusion 41 of the manipulation member 40 to enable the manipulation member 40 to be moved downward, convex portions of the manipulation uneven portions 43 engaged with and coupled to the detection uneven portions 53 move while pushing convex portions of the detection uneven portions 53, thus enabling the detection means 30 to be rotated about the hinge pin 51 and the detection pins 55 to be inserted into the detection holes 23 of the connecting rod bodies 22, thereby detecting the combination of the dials 24.

In addition, the manipulation uneven portions 43 and the detection uneven portions 53 that are respectively included in the manipulation member 40 and the detection member 50 of the detection means 30 have a plurality of concave and convex portions to correspond to each other, and opposing convex portions of the manipulation uneven portions 43 and the detection uneven portions 53 further have guide inclined surfaces 43*a* and 53*a* to correspond to each other and are configured such that, when moving downward, the manipulation uneven portions 43 push the concave portions of the detection uneven portions 53 while moving along the guide inclined surfaces 43*a* and 53*a*.

In addition, the manipulation uneven portions 43 and the detection uneven portions 53 that are respectively included in the manipulation member 40 and the detection member 50 of the detection means 30 have a plurality of concave and convex portions to correspond to each other, and opposing convex portions of the manipulation uneven portions 43 and the detection uneven portions 53 further have guide inclined surfaces 43*a* and 53*a* to correspond to each other, wherein the guide inclined surfaces 43*a* and 53*a* are molded into helical surfaces tapered from one side to another side, wherein, when moving downward, the manipulation uneven portions 43 pushes the convex portions of the detection uneven portions 53 along the helical surfaces that correspond to each other, thereby transmitting rotational force to the detection member 50.

In addition, the detection member 50 includes a plurality of dial supports 54 consecutively provided on the other side thereof about the hinge pin 51 and positioned between the dials 24 to maintain a gap therebetween, wherein each dial support includes each of the detection pins 55 corresponding to the detection holes 23 of the connecting rod bodies 22 respectively fitted into and coupled to the dials 24, and a return spring 56 that allows the detection pin 55 to protrude and return to an original position, wherein, in a state in which a front end of the detection pin 55 comes into contact with an outer diameter surface of the connecting rod body 22 to press the return spring 56, to detect the combination, the connecting rod body 22 is rotated along with the dial 24, thereby inserting the detection pin 55 into the detection hole 23 of the connecting rod body 22 to detect a number of the corresponding dial 24.

Advantageous Effects

According to the present invention, a combination of a dial lock can easily be identified or reset even in a state in which a door of a locker is closed, thus not only providing user convenience, but also enabling more convenient management of the locker.

In addition, a detection means for identifying a combination of dials is embedded inside a main body, and thus breakdown and loss of components are prevented, and malfunction of a product is prevented, thereby improving user convenience and product satisfaction.

BEST MODE

A dial lock for a locker according to the present invention has been made to enhance user convenience by conveniently changing and resetting a combination by rotating a knob for operating a locking lever of a dial lock to a reset position not to a locking or opening position, and then identifying or resetting the combination of dials.

Hereinafter, characteristics of configurations and an assembly method of a dial lock for a locker according to the present invention will be understood by embodiments set forth herein with reference to the accompanying drawings.

Figure 1:
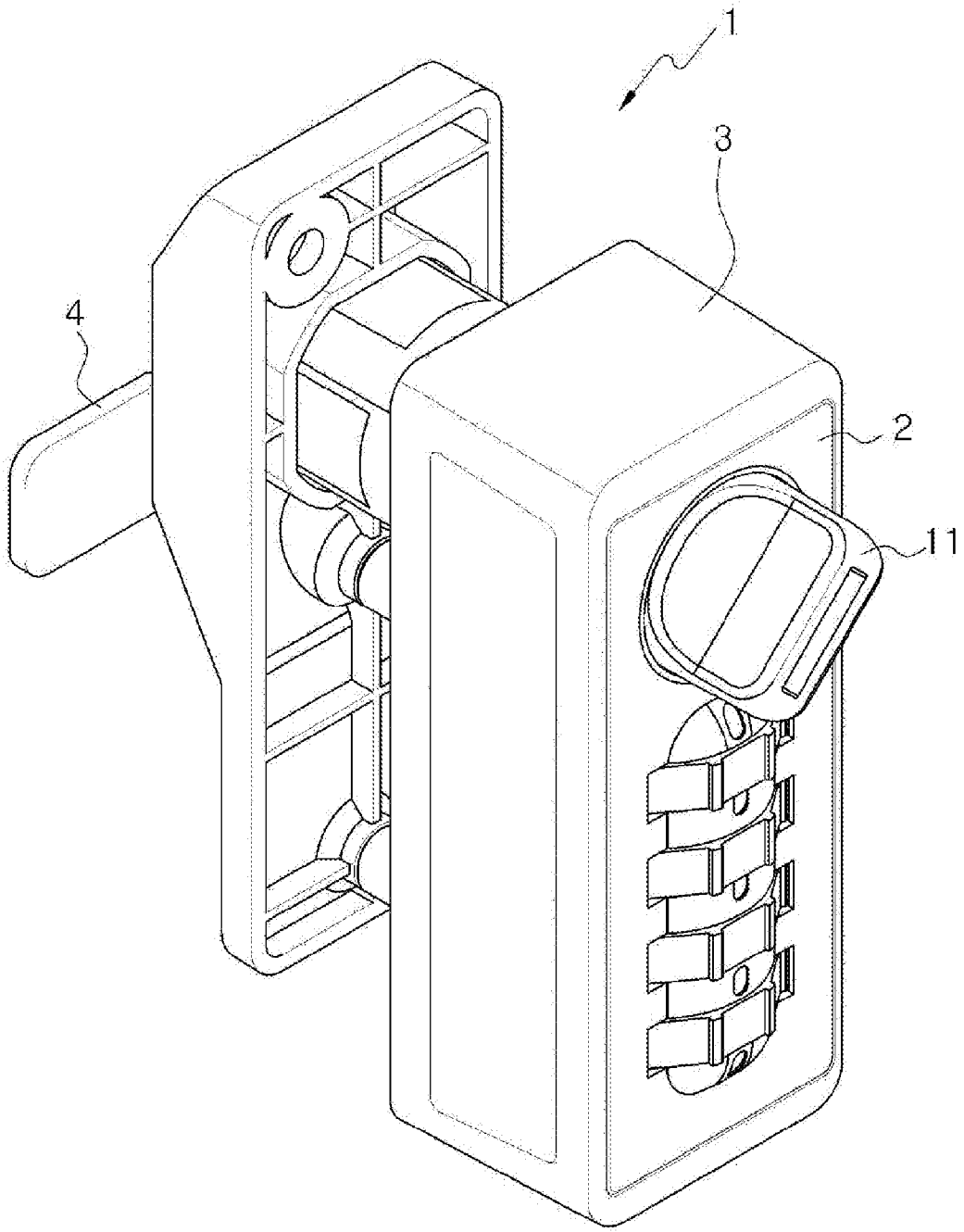
FIG. 1 is a combined perspective view of a dial lock according to the present invention.
Figure 2:
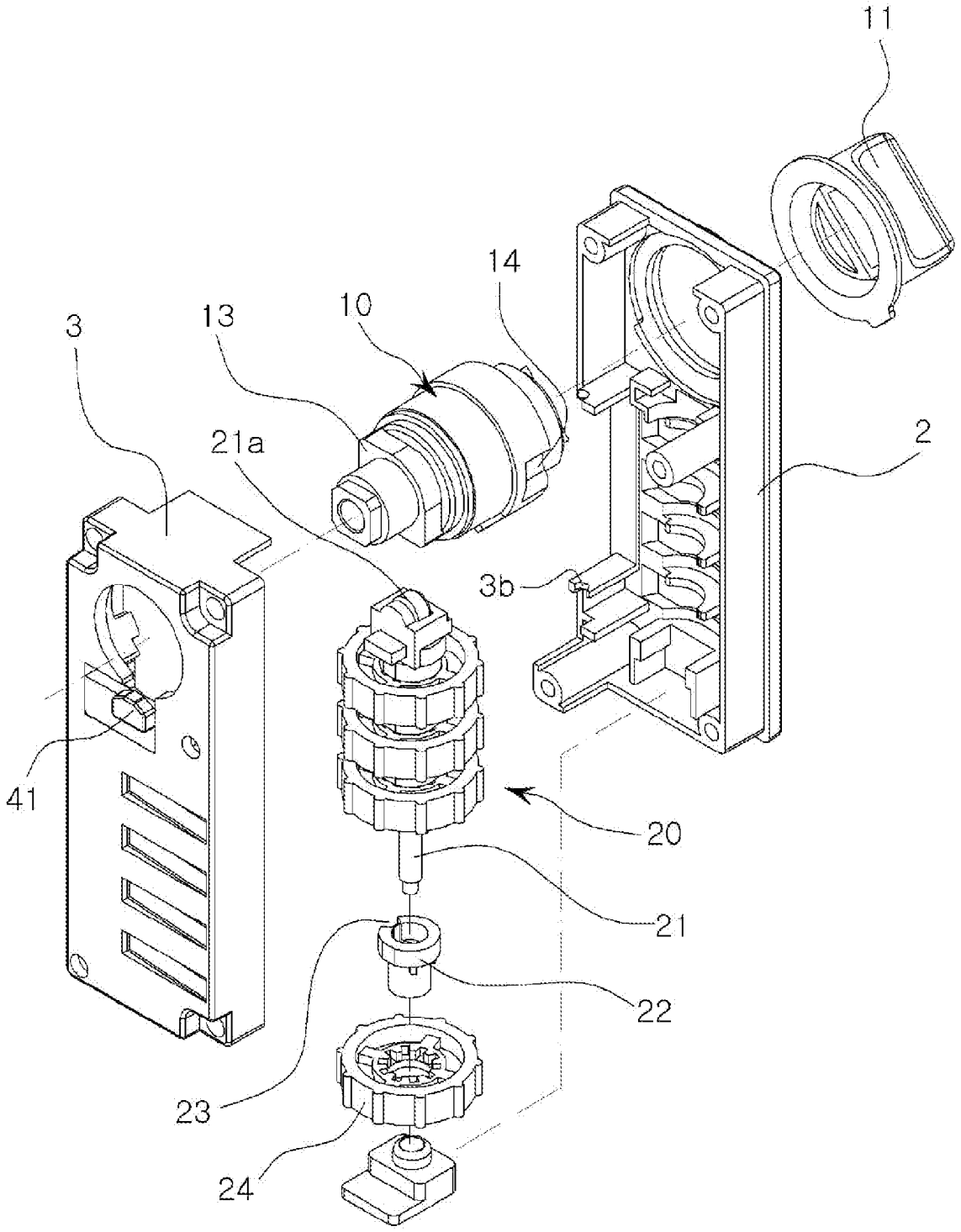
FIG. 2 is an exploded perspective view of a dial lock according to the present invention.

First, before describing the present invention in detail, a dial lock 1 according to the present invention will be briefly described. The dial lock 1 is commonly and widely used and, as illustrated in FIGS. 1 and 2, has a dual structure consisting of a locking device using a key in which a private key (not shown) and a cylinder-type lock are used to lock or open a locker, and a locking device using a plurality of dials 24 in which a combination is set using the plurality of dials 24, the plurality of dials 24 are rotated to match the set combination, thereby opening or closing a door of a locker.

In addition, in the present invention, to set a combination for the dial lock 1, first, a knob 11 of a door is placed at a setting position present between opening and closing positions using a private key or a master key, a combination is set using the plurality of dials 24, the knob 11 is rotated to an opening or closing position, the key is separated, the door is opened or closed after belongings are stowed, and then the plurality of dials 24 are randomly rotated to maintain the locked state.

In this regard, the knob 11 may be operably connected to the key cylinder bundle 10, which is known, and the key cylinder bundle 10 may be rotated using the knob 11 and a key, and internal configurations of the key cylinder bundle 10 are generally known, and thus detailed descriptions thereof will be omitted herein.

The key cylinder bundle 10 is positioned in an internal space between a main body 3 and a cover 2 that are connected to each other, an operating rod insertion portion 14 for operating an operating rod 21 of a dial bundle 20, which will be described below, is placed in the front of the key cylinder bundle 10 on the side of the cover 2, and a pressing cam part 13 for operating a manipulation member 40 of a detection means 30, which will be described below, is provided in the rear thereof on the side of the main body 3.

Figure 3:
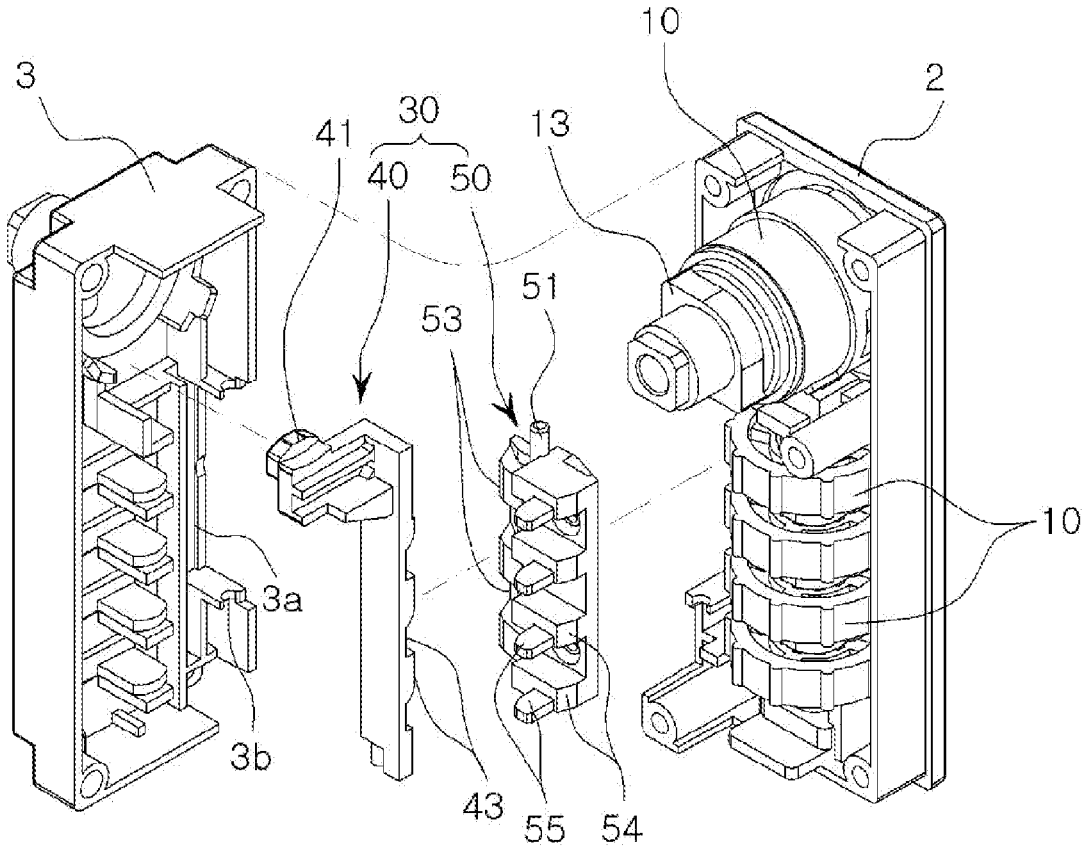
FIG. 3 is a perspective view illustrating a state in which a detection means is separated from a main body, according to the present invention.
Figure 4:
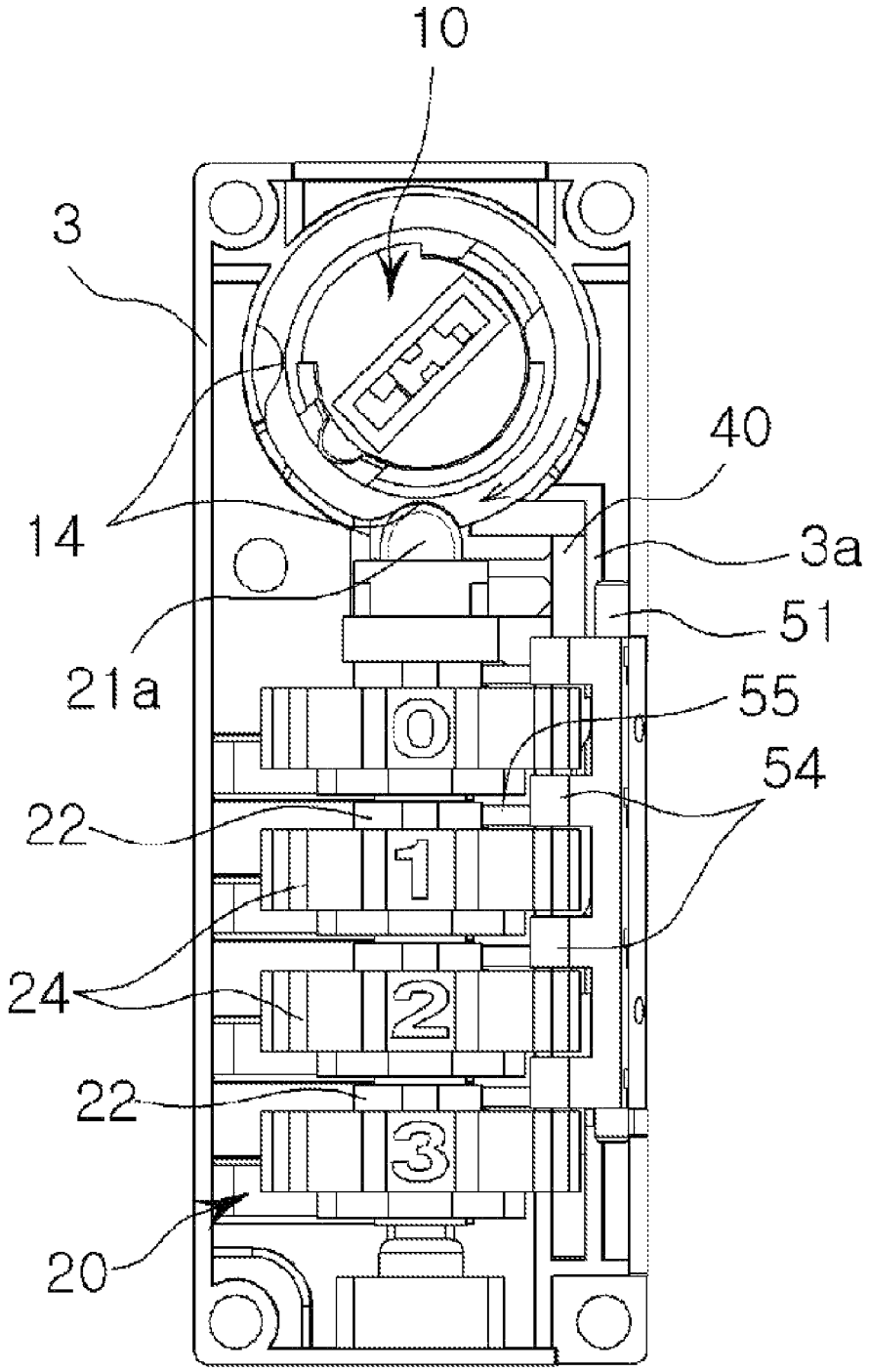
FIG. 4 is a front view illustrating an operating state of a dial bundle according to the present invention.

In addition, the dial bundle 20, which is installed in the internal space between the main body 3 and the cover 2 that are connected to each other and includes a plurality of dials 24 exposed to a front surface of the cover 2, is configured such that, as illustrated in FIGS. 2 and 3, the plurality of dials 24 and connecting rod bodies 22 are fitted into and coupled to each other around the operating rod 21, a detection hole 23 formed in an upper end of each of the connecting rod bodies 22, which are fitted into and coupled to the dials 24, is not exposed in a general state, but when a user places the knob 11 at a setting position, an upper push head 21*a* of the operating rod 21 placed in the operating rod insertion portion 14 of the key cylinder bundle 10 is pressed downward, and the connecting rod body 22 is simultaneously moved downward, thereby enabling the detection hole 23 formed in one side of the upper end of the connecting rod body 22 to be exposed, and then when the knob 11 is moved to a locking or opening position, the operating rod 21 and the connecting rod bodies 22 return to the original position by elastic force of an elastic member so that the detection holes 23 are covered by the dials 24.

The above-described structure of the dial bundle 20 in which, according to movement of the operating rod 21, the connecting rod bodies 22 move along therewith and the detection hole 23 is exposed to the outside of each dial 24 is already known, and thus a detailed description thereof will be omitted herein.

The greatest characteristic of the present invention is to enable a user to identify or reset a combination from the outside while a door is closed, by using a private key or a master key, and to this end, by pressing the operating rod 21 of the dial bundle 20 using rotation of the key cylinder bundle 10 to expose the detection holes 23 and simultaneously operating the detection means 30 by the pressing cam part 13 of the key cylinder bundle 10, detection pins 55 included in the detection means 30 are installed in the detection holes 23 of the connecting rod bodies 22.

To this end, as illustrated in FIG. 3, the detection means 30 broadly includes the manipulation member 40 that is slidably moved upward or downward by the key cylinder bundle 10 and a detection member 50 that horizontally rotates according to movement of the manipulation member 40 and installs the detection pins 55 in the detection holes 23 included in the dial bundle 20.

Figure 5:
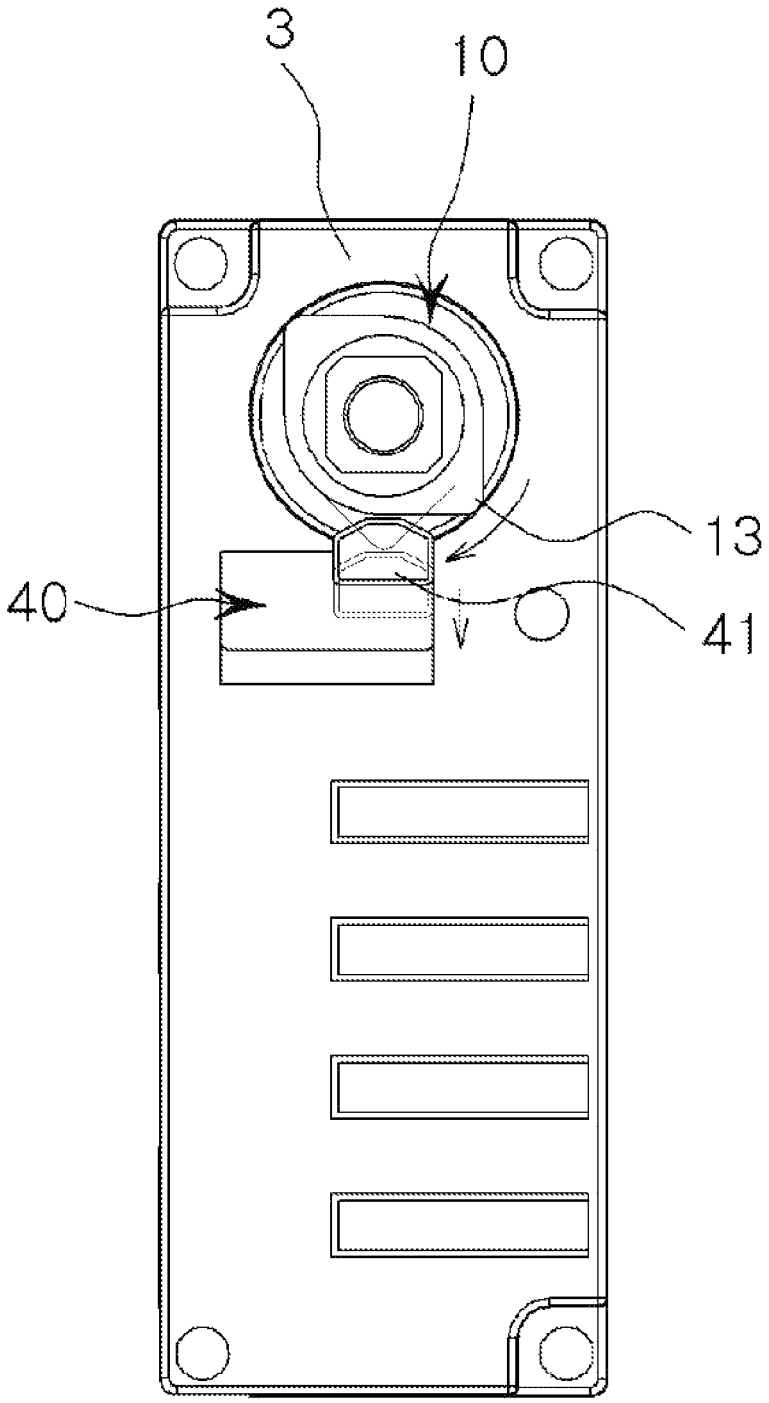
FIG. 5 is a rear view illustrating an operating state of a key cylinder bundle according to the present invention.
Figure 6:
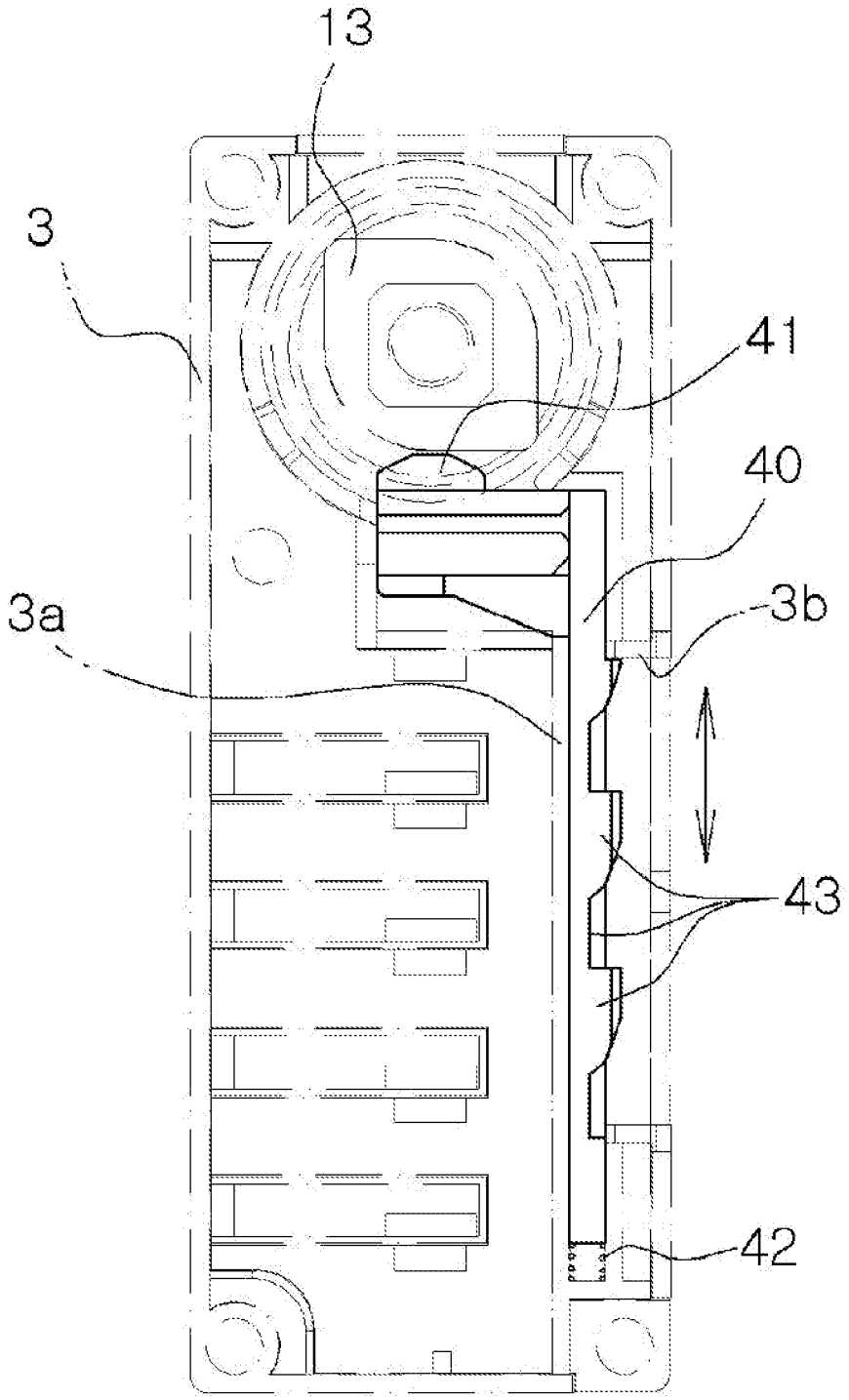
FIG. 6 is a front view illustrating an operating state of a manipulation member according to the present invention.

The manipulation member 40 is in the form of an "¬" shaped plate and includes a push protrusion 41 provided on a central upper portion of a horizontal part thereof and placed in a key cylinder bundle installation hole (not shown) of the main body 3, a return spring 42 supported on the main body 3 at a lower end of a vertical part vent at one side of the manipulation member 40, and a plurality of manipulation uneven portions 43 provided at a side surface of the vertical part and slidably assembled upward or downward in the main body 3, and as illustrated in FIG. 5, the pressing cam part 13 of the key cylinder bundle 10 presses the push protrusion 41 in a state of being placed at a setting position, and thus a state in which the manipulation member 40 is moved downward inside the main body 3 is maintained.

The manipulation member 40 is in the form of an "¬" shaped plate wherein the horizontal part is provided at the center so as to come into contact with the pressing cam part 13 of the key cylinder bundle 10, and the vertical part is positioned proximate to a sidewall of the main body 3 while not interfering with the dial bundle 20.

In this regard, the main body 3 may further include a protruding rail portion 3*a* provided on an inner side thereof to be slidably moved in a state in which the bent vertical part of the manipulation member 40 is inserted into the rail portion 3*a* so that the manipulation member 40 can be more stably and accurately moved.

In addition, the rail portion 3*a* of the main body 3 has an opening at one side thereof and includes hinge pin supports 3*b* at upper and lower portions thereof to accommodate a hinge pin 51 of the detection member 50 therein so that the detection member 50 is rotatably assembled about the hinge pin 51.

Figure 7:
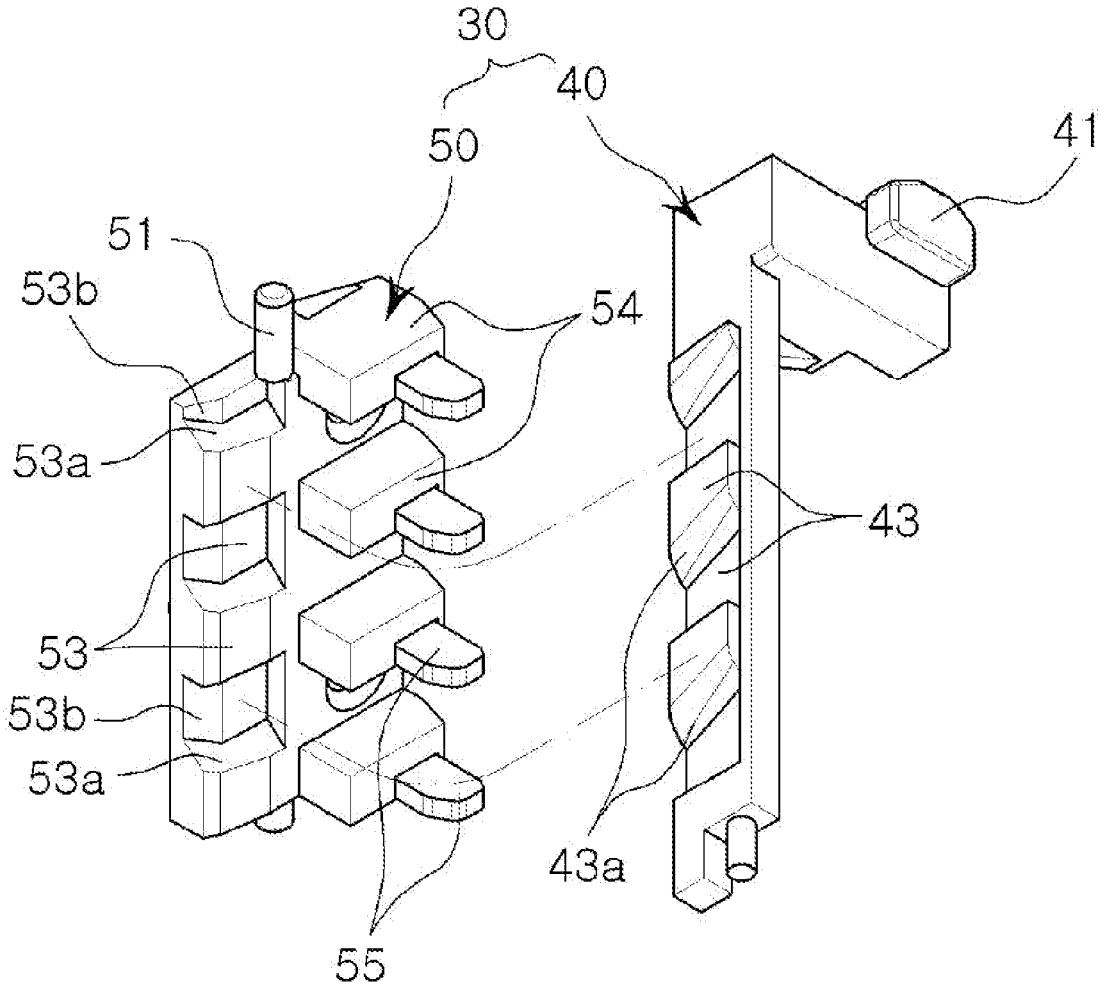
FIG. 7 is an exploded perspective view of a detection means according to the present invention.
Figure 8:
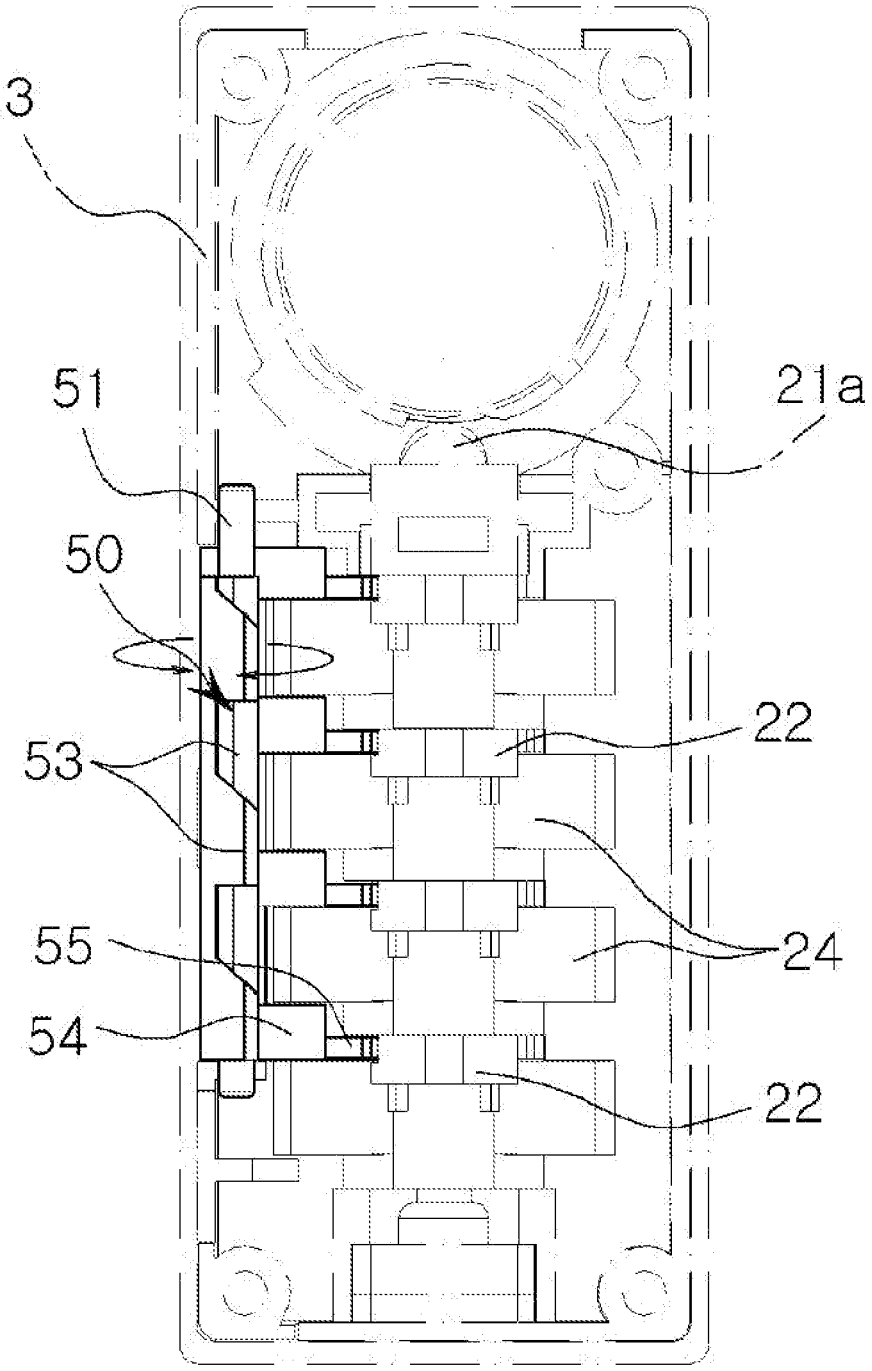
FIG. 8 is a rear view illustrating an operating state of a detection member according to the present invention.

As illustrated in FIGS. 7 and 8, the detection member 50 includes detection uneven portions 53 on one side thereof about the hinge pin 51 to correspond to a plurality of manipulation uneven portions 43 included in the manipulation member 40, and the detection pins 55 on another side thereof to be inserted into the detection holes 23 of the connecting rod bodies 22, and each detection pin 55 is positioned between the dials 24 and movably installed forward or backward at each of a plurality of dial supports 54 for maintaining a gap therebetween.

That is, the dial supports 54 are configured such that, in a state in which the detection pins 55 corresponding to the detection holes 23 of the connecting rod bodies 22 respectively fitted into and coupled to the plurality of dials 24, and return springs 56 that allow the detection pins 55 to protrude are accommodated in respective internal spaces thereof, an outer surface of each dial support 54, i.e., a surface thereof into which the detection pin 55 and the return spring 56 are inserted, is fixed by a finishing cover (not shown), wherein the detection pin 55 protrudes forward of each dial support 54 that is inserted between the dials 24 to maintain the gap therebetween and a front end thereof is maintained in a state of being contact with an outer diameter surface of the connecting rod body 22.

In this regard, a detection restoration spring 52 is further provided between the detection member 50 and the sidewall of the main body 3 to press the detection uneven portions 53 of the detection member 50 towards the manipulation member 40 all the time.

In addition, a connected surface of the manipulation member 40 and the detection member 50 which constitute the detection means 30 has a state in which the manipulation uneven portions 43 and the detection uneven portions 53 are engaged with and coupled to each other and, as illustrated in FIG. 8, according to downward movement of the manipulation member 40, the detection member 50 is rotated about the hinge pin 51 at a certain angle.

The manipulation uneven portions 43 and the detection uneven portions 53 that are respectively included in the manipulation member 40 and the detection member 50 have a plurality of concave and convex portions to correspond to each other, and the opposing convex portions of the manipulation uneven portions 43 and the detection uneven portions 53 further have guide inclined surfaces 43*a* and 53*a* which correspond to each other and are configured such that, when moving downward, the manipulation uneven portions 43 push the concave portions of the detection uneven portions 53 while moving along the guide inclined surfaces 43*a* and 53*a*.

Thus, the detection member 50 may be naturally rotated in such a way that, while the detection uneven portions 53 are pushed to the other side, the detection pin 55 on one side is moved forward about the hinge pin 51 and, at this time, the detection restoration spring 52 is compressed and the detection pins 55 provided on one side of the detection member 50 are simultaneously pressed against an outer diameter surface of each connecting rod body 22, thereby compressing the return spring 56.

In this regard, a configuration in which the guide inclined surfaces 43*a* and 53*a* of the manipulation uneven portions 43 and the detection uneven portions 53 that are respectively included in the manipulation member 40 and the detection member 50 are molded into helical surfaces tapered from one side to the other side, and thus when moving downward, the manipulation uneven portions 43 push the convex portions of the detection uneven portions 53 while moving along the corresponding helical surfaces to thereby easily transmit rotational force to the detection member 50, also falls within the scope of the present invention.

In addition, while the detection uneven portions 53 of the detection member 50 have a plurality of concave and convex surfaces which are consecutively provided, the concave portions thereof are further provided with support inclined surfaces 53*b* tapered in the rearward direction, and thus the support inclined surfaces 53*b* are caught by the convex portions of the detection uneven portions 53 so that the detection member 50 is freely moved about the hinge pin 51 at a certain interval.

Thus, generally, when the dials 24 are rotated to use the dial lock 1, the detection member 50 is rotatable about the hinge pin 51 together with the detection pins 55 in contact with the connecting rod bodies 22, and thus malfunction of components may be prevented.

Hereinafter, embodiments of an operation process for the dial lock 1 according to the present invention will be described in detail with reference to the accompanying drawings.

First, a process of opening or locking the dial lock 1 according to the present invention and configurations of the key cylinder bundle 10 and the dial bundle 20 are generally known, and thus detailed descriptions thereof will be omitted herein. Herein, a process of detecting a combination and determining dial numbers by rotating the locked key cylinder bundle 10 through a master key will mainly be described.

Figure 9A:
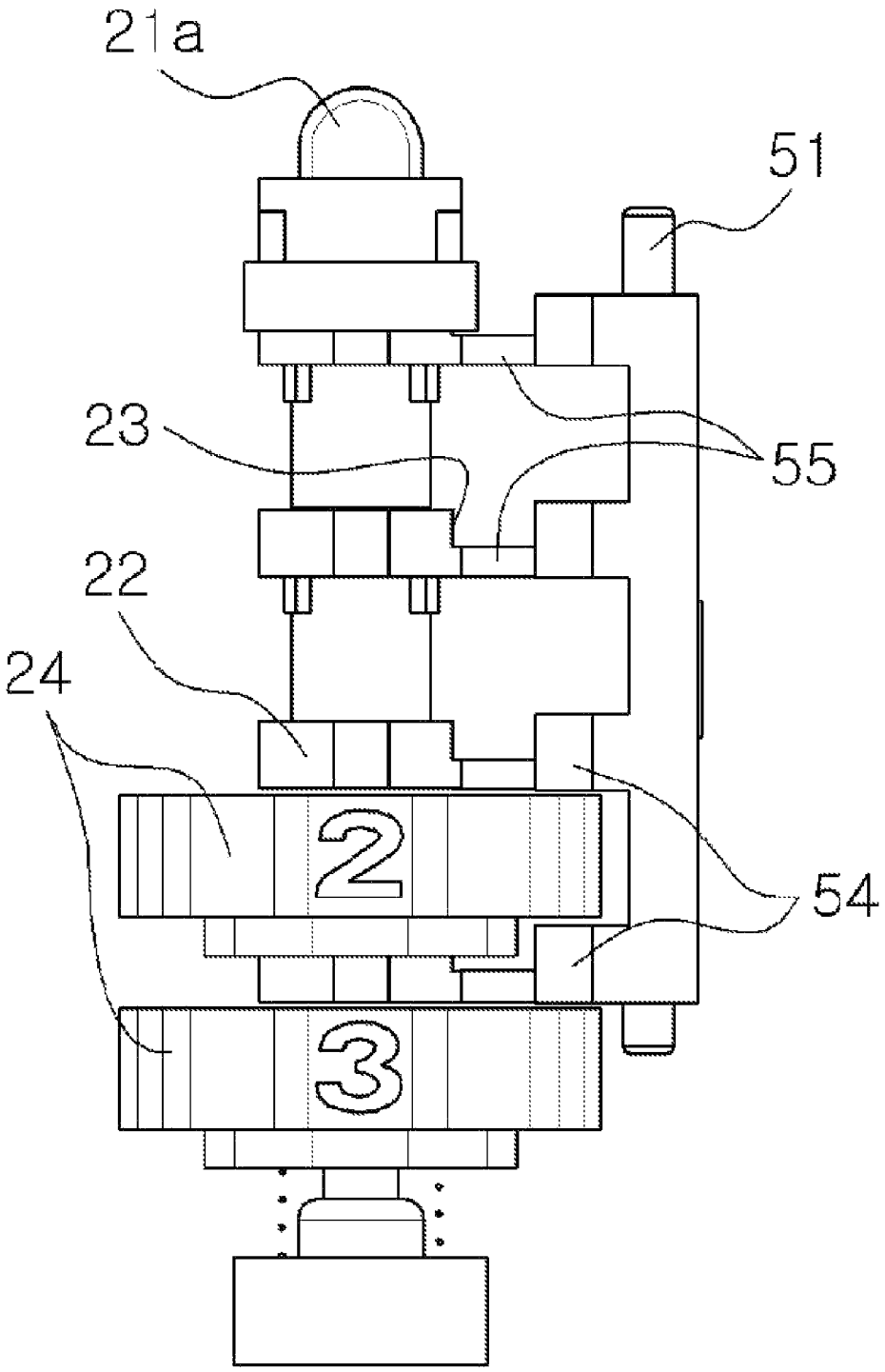
FIGS. 9A and 9B are a front view and a plan cross-sectional view illustrating general usage states of a detection means.
Figure 9B:
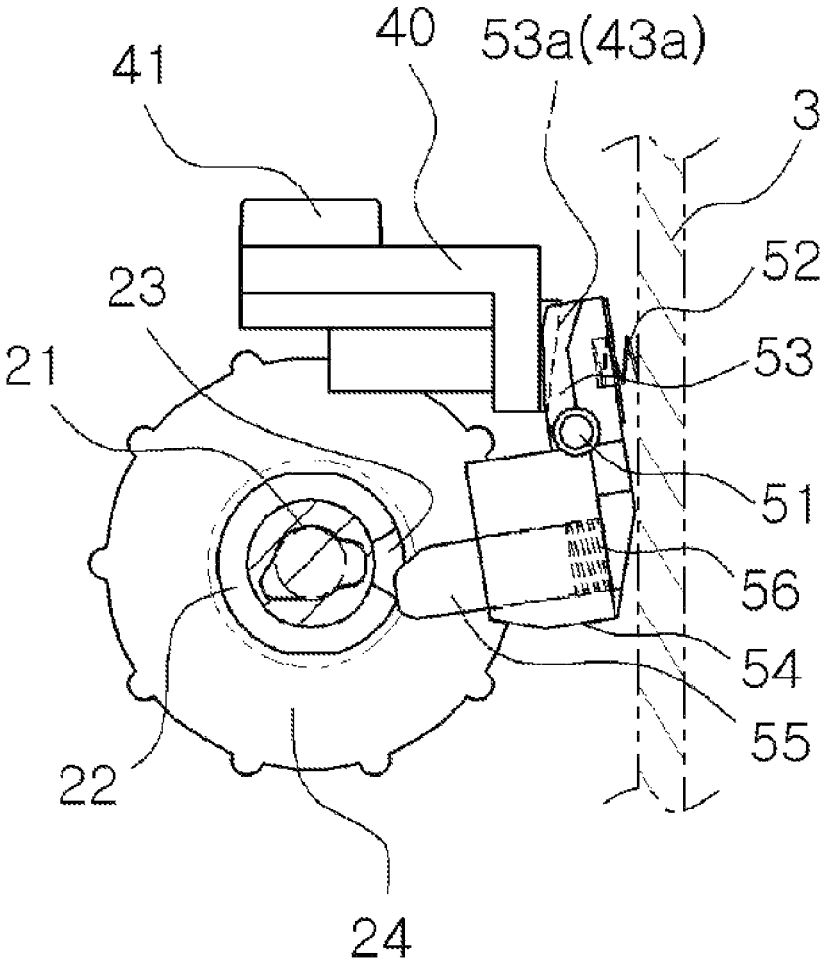

FIGS. 9A and 9B illustrate a state in which a user knows a combination of the dial lock 1 or a state in which a door of a locker is locked because a user forgets a combination, wherein the push head 21*a* of the operating rod 21 protrudes upward, and thus the detection holes 23 of the connecting rod bodies 22 are not exposed, the detection member 50 is in a state in which the detection uneven portions 53 are engaged with and coupled to the manipulation uneven portions 43 by elasticity of the detection restoration spring 52, and the detection pins 55 of the detection member 50 are in a state of simply contacting the outer diameter surfaces of the connecting rod bodies 22.

Thus, when a user determines the combination of the dial lock 1 because the user forgets the combination or when resetting the combination, the key cylinder bundle 10 of the dial lock 1 is rotated to a setting position placed between opening and locking positions, by using a master key.

In this case, the key cylinder bundle 10 has the knob 11 connected thereto at a front side of the cover 2 and includes an opening or locking display unit at a front surface of the cover 2 so that a user can more easily recognize the setting position through the position of the knob 11.

As described above, when the key cylinder bundle 10 is rotated to the setting position, the push head 21*a* of the operating rod 21 inserted into the operating rod insertion portion 14 is pressed by the outer diameter surface of the key cylinder bundle 10 so that the operating rod 21 including the connecting rod bodies 22 moves downward, and the push protrusion 41 of the manipulation member 40 is slidably moved downward by the pressing cam part 13 further included in the rear portion of the key cylinder bundle 10.

Figure 10A:
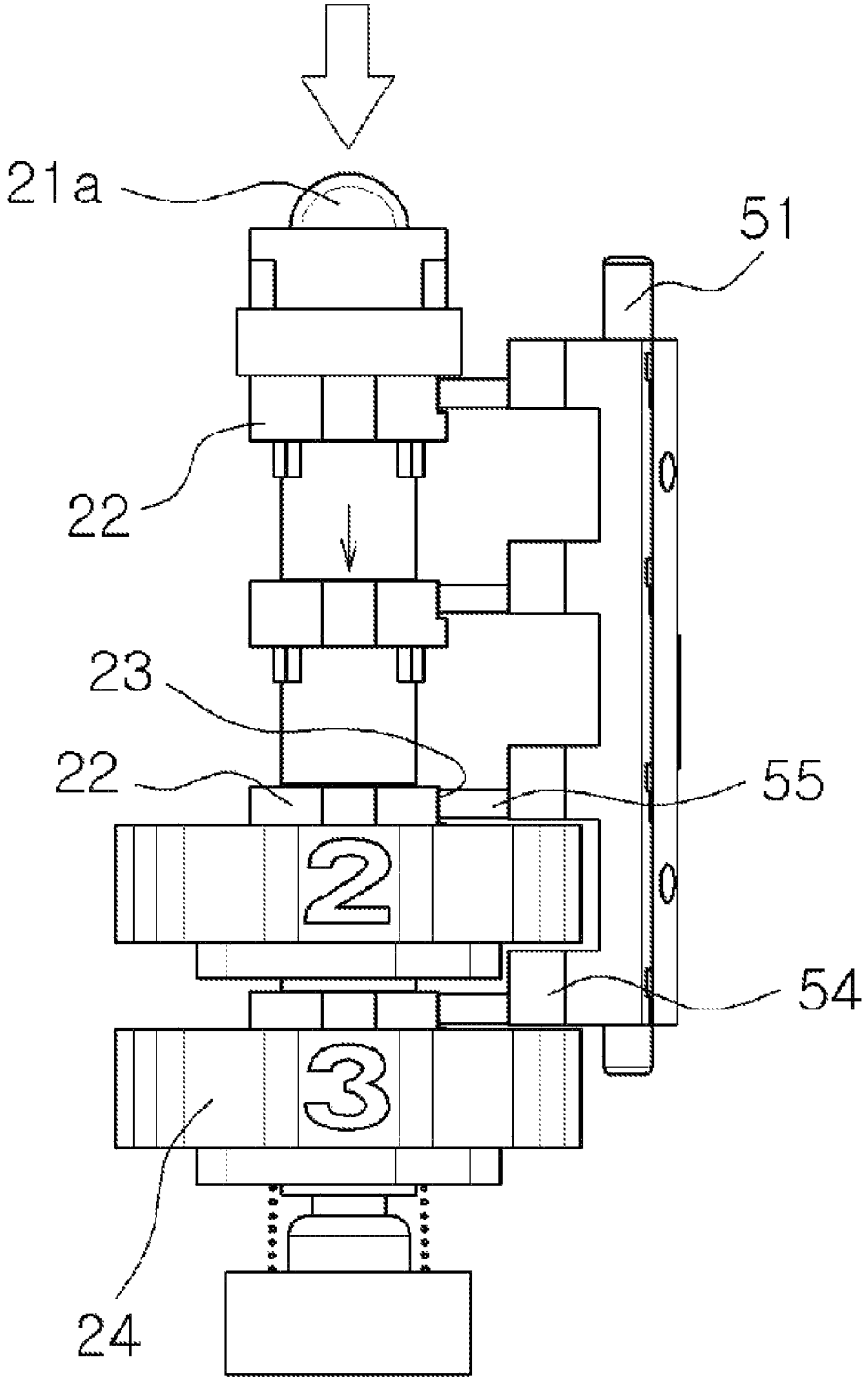
FIGS. 10A and 10B are a front view and a plan cross-sectional view illustrating usage states for identifying a combination using a detection means.

Thus, as illustrated in FIG. 10A, the detection holes 23 of the connecting rod bodies 22 moved downward along with the operating rod 21 are exposed, and the detection restoration spring 52 is compressed about the hinge pin 51 by the manipulation member 40 slidably moved downward by the pressing cam part 13 of the key cylinder bundle 10 and the detection pins 55 are rotated towards the connecting rod bodies 22 so that the detection pins 55 compress the return springs 56.

Figure 10B:
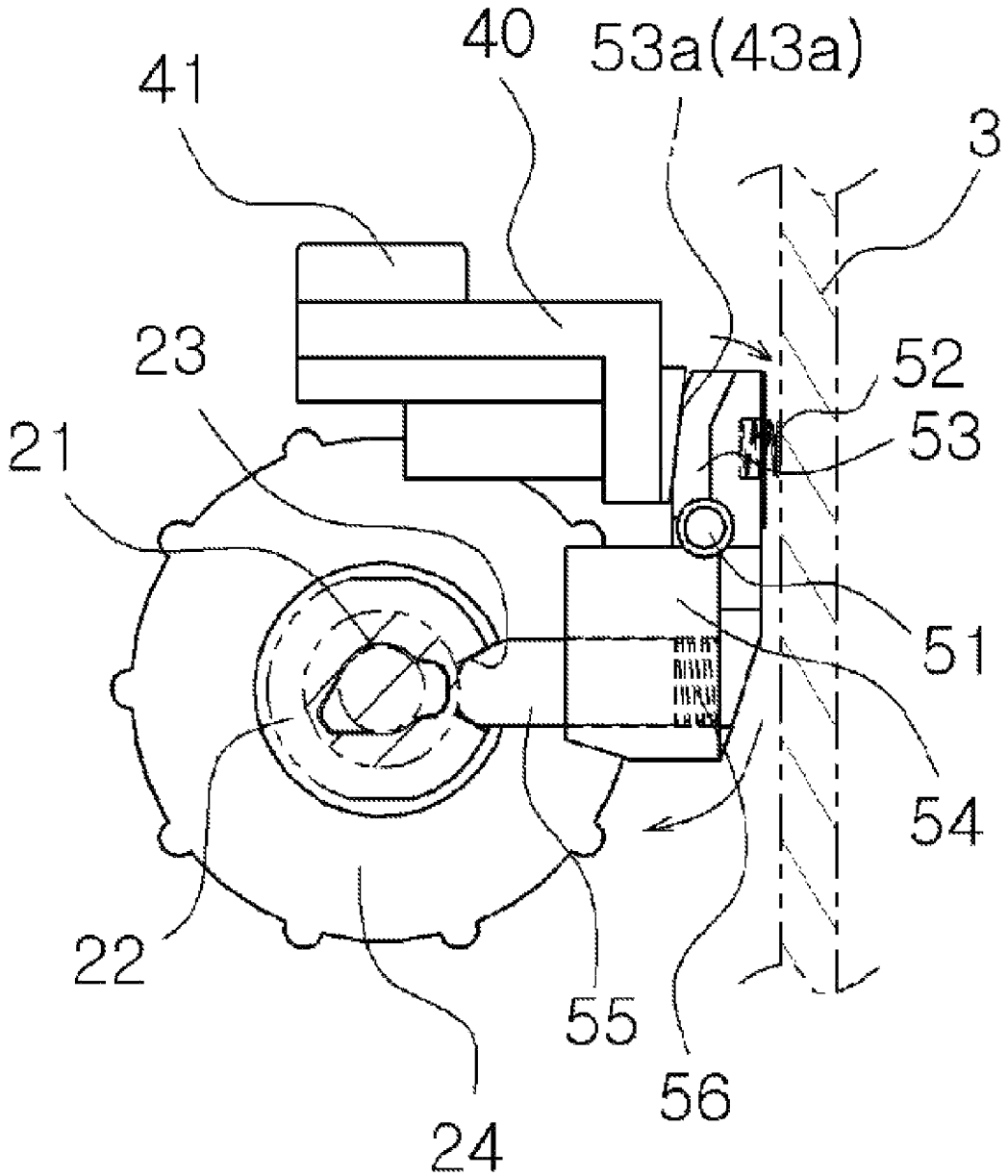

That is, as illustrated in FIG. 10B, the manipulation uneven portions 43 and the detection uneven portions 53 that are respectively included in the manipulation member 40 and the detection member 50 are in a state in which a plurality of concave and convex portions provided to correspond to each other are generally engaged with and coupled to each other, but in such a setting state, while moving downward, the convex portions of the manipulation uneven portions 43 move along and push rightward the convex portions of the detection uneven portions 53 when viewed from the drawing, thus being rotated about the hinge pin 51.

Accordingly, the detection member 50 may be naturally rotated in such a manner that, while the detection uneven portions 53 are pushed to the other side, the detection pins 55 on one side moves, about the hinge pin 51, leftward when viewed from the drawing, and as the detection restoration spring 52 of the detection member 50 is compressed, the detection pins 55 provided on one side are pressed against the outer diameter surfaces of the connecting rod bodies 22, thereby compressing the return springs 56.

In addition, to determine the combination, when a user rotates the dials 24 including the connecting rod bodies 22 to place the detection holes 23 at the positions of the detection pins 55, the detection pins 55 are allowed to protrude by elasticity of the compressed return springs 56 and be inserted into the detection holes 23, thereby restricting the rotational movement of the dials 24.

As described above, to detect the combination, through a process of rotating the connecting rod bodies 22 together with the dials 24 to allow front ends of the detection pins 55 to be inserted into the detection holes 23 of the connecting rod bodies 22, which are being rotated, the front end of each detection pin 55 is inserted into the detection hole 23 of the connecting rod body 22 by consecutively rotating multi-stage dials 24, thus enabling a user to easily recognize numbers of the dials 24 exposed to the outside of the cover 2, which are forgotten.

After the combination of the dial lock 1, which has been forgotten, is detected or reset through the above-described process, the master key is separated, and then when the knob 11 assembled to the key cylinder bundle 10 is rotated to an opening or locking direction, the manipulation member 40 moved downward by the pressing cam part 13 is moved upward by the return spring 42, and pressing against the detection member 50 is released so that the detection member 50 returns to the state of FIG. 9B even using the elasticity of the detection restoration spring 52.

In addition, according to vertical movement of the operating rod 21 together with the connecting rod bodies 22 so that the push head 21 is inserted into the operating rod insertion portion 14 of the key cylinder bundle 10, it allows a return to a state before the combination is set, in which the detection holes 23 are not exposed, thereby completing all works for detecting the combination of the dial lock 1.

As described above, the aforementioned embodiments are provide for the explanation of the most exemplary embodiments and are not intended to limit the present invention, and it will be obvious to those of ordinary skill in the art that various modifications can be made without departing from the technical spirit of the present invention.

The invention claimed is:

1. A locker dial lock, which is a dial lock (1) configured such that a main body (3) comprising a key cylinder bundle (10) and a dial bundle (20) is installed at a front surface of a door of a locker, and when a plurality of dials (24) exposed to the outside of a cover (2) at a front surface of the main body (3) are rotated to match a set combination, the key cylinder bundle (1) is released and a door is opened by rotating a locking lever (4) at a back surface of the door along with a knob (11), and when the combination is forgotten, the knob (11) is rotated using a master key to press an operating rod (21) of the dial bundle (20), thereby allowing detection holes (23) provided on one side of connecting rod bodies (22) respectively fitted into and coupled to the plurality of dials (24) to be exposed, and the detection pins (55) of a detection means (30) that are provided on one side of the connecting rod bodies (22) are inserted into the detection holes (23) to determine a combination of the dials (24), wherein the detection means (30) comprises:

a manipulation member (40) having a push protrusion (41) at an upper portion thereof, comprising a return spring (42) on a lower portion thereof, and provided with a plurality of manipulation uneven portions (43) on one side thereof, wherein the push protrusion (41) is pressed by a pressing cam part (13) further included in the key cylinder bundle (10) such that the manipulation member (40) is slidably moved upward or downward; and a detection member (50) positioned on one side of the manipulation member (40) and rotatably assembled to the main body (3) about a hinge pin (51), provided with detection uneven portions (53) on one side thereof to correspond to the plurality of manipulation uneven portions (43) about the hinge pin (51), and comprising the detection pins (55) provided on another side thereof and inserted into the detection holes (23) of the connecting rod bodies (22), wherein, when the combination is forgotten, the knob (11) is rotated to a setting position using a master key to allow the key cylinder bundle (10) to press the operating rod (21) of the dial bundle (20), thereby exposing the detection holes (23) provided in one side of the connecting rod bodies (22) respectively fitted into and coupled to the plurality of dials (24), and while the pressing cam part (13) of the key cylinder bundle (10) presses the push protrusion (41) of the manipulation member (40) to enable the manipulation member (40) to be moved downward, convex portions of the manipulation uneven portions (43) engaged with and coupled to the detection uneven portions (53) move while pushing convex portions of the detection uneven portions (53), thus enabling the detection means (30) to be rotated about the hinge pin (51) and the detection pins (55) to be inserted into the detection holes (23) of the connecting rod bodies (22), thereby detecting the combination of the dials (24).

2. The locker dial lock according to claim 1, wherein the manipulation uneven portions (43) and the detection uneven portions (53) that are respectively included in the manipulation member (40) and the detection member (50) of the detection means (30) have a plurality of concave and convex portions to correspond to each other, and opposing convex portions of the manipulation uneven portions (43) and the detection uneven portions (53) further have guide inclined surfaces (43*a*) and (53*a*) to correspond to each other and are configured such that, when moving downward, the manipulation uneven portions (43) push the concave portions of the detection uneven portions (53) while moving along the guide inclined surfaces (43*a*) and (53*a*).

3. The locker dial lock according to claim 1, wherein the manipulation uneven portions (43) and the detection uneven portions (53) that are respectively included in the manipulation member (40) and the detection member (50) of the detection means (30) have a plurality of concave and convex portions to correspond to each other, and opposing convex portions of the manipulation uneven portions 43 and the detection uneven portions (53) further have guide inclined surfaces (43*a*) and (53*a*) to correspond to each other, wherein the guide inclined surfaces (43*a*) and (53*a*) are molded into helical surfaces tapered from one side to another side, wherein, when moving downward, the manipulation uneven portions (43) pushes the convex portions of the detection uneven portions (53) along the helical surfaces that correspond to each other, thereby transmitting rotational force to the detection member (50).

4. The locker dial lock according to claim 1, wherein the detection uneven portions (53) provided on a front surface of one side of the detection member (50) comprise a plurality of consecutive concave and convex surfaces, wherein the concave surface is further provided with a support inclined surface (53*b*) tapered in a rearward direction, wherein, while the detection member (50) is rotated, the convex portions of the detection uneven portions (53) are caught by the support inclined surface 53*b*, thus enabling the detection member (50) to be freely moved about the hinge pin (51) at a certain interval.

5. The locker dial lock according to claim 1, wherein the detection member (50) comprises a plurality of dial supports (54) consecutively provided on the other side thereof about the hinge pin and positioned between the dials (24) to maintain a gap therebetween, wherein each dial support comprises each of the detection pins (55) corresponding to the detection holes (23) of the connecting rod bodies (22) respectively fitted into and coupled to the dials (24), and a return spring (56) that allows the detection pin (55) to protrude and return to an original position, wherein, in a state in which a front end of the detection pin (55) comes into contact with an outer diameter surface of the connecting rod body (22) to press the return spring (56), to detect the combination, the connecting rod body (22) is rotated along with the dial (24), thereby inserting the detection pin (55) into the detection hole (23) of the connecting rod body (22) to detect a number of the corresponding dial (24).

* * * * *